US007731641B1

(12) United States Patent
Chen

(10) Patent No.: US 7,731,641 B1
(45) **Date of Patent: *Jun. 8, 2010**

(54) ADJUSTABLE DUMBBELL

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 0 days.

This patent is subject to a terminal disclaimer.

(21) Appl. No.: 12/321,604

(22) Filed: Jan. 22, 2009

(51) Int. Cl.
*A63B 21/072* (2006.01)

(52) U.S. Cl. ..... 482/108; 482/106; 482/93

(58) Field of Classification Search ..... 482/93, 482/106–108; D21/680–682
See application file for complete search history.

(56) References Cited

U.S. PATENT DOCUMENTS

| | | | | | |
|---|---|---|---|---|---|
| 1,316,683 | A * | 9/1919 | Calvert | 482/93 |
| 3,771,785 | A * | 11/1973 | Speyer | 482/106 |
| 5,484,367 | A * | 1/1996 | Martinez | 482/107 |
| 5,839,997 | A | 11/1998 | Roth et al. | 482/107 |
| 5,879,274 | A | 3/1999 | Mattox | 482/107 |
| 6,656,093 | B2 | 12/2003 | Chen | 482/108 |
| 6,719,674 | B2 | 4/2004 | Krull | 482/106 |
| 6,733,424 | B2 | 5/2004 | Krull | 482/92 |
| 7,048,678 | B2 * | 5/2006 | Harms et al. | 482/107 |
| 7,137,931 | B2 | 11/2006 | Liu | 482/107 |
| 7,172,536 | B2 | 2/2007 | Liu | 482/108 |
| 7,223,214 | B2 | 5/2007 | Chen | 482/107 |
| 7,413,533 | B2 * | 8/2008 | Lin | 482/108 |
| 7,553,265 | B2 * | 6/2009 | Crawford et al. | 482/108 |
| 7,563,208 | B1 * | 7/2009 | Chen | 482/93 |
| 2006/0035767 | A1 * | 2/2006 | Ekhaus | 482/108 |
| 2006/0105891 | A1 * | 5/2006 | Cappellini et al. | 482/107 |
| 2006/0172871 | A1 * | 8/2006 | Cao | 482/106 |
| 2007/0225132 | A1 * | 9/2007 | Liu | 482/106 |
| 2009/0023563 | A1 * | 1/2009 | Liang | 482/106 |
| 2009/0124470 | A1 * | 5/2009 | Yu | 482/107 |

* cited by examiner

*Primary Examiner*—Fenn C Mathew
(74) *Attorney, Agent, or Firm*—Charles E. Baxley

(57) ABSTRACT

An adjustable dumbbell includes a handle having a narrowed neck segment formed on each end portion and having a base plate attached to each end portion, two or more weight members each having a slot for receiving the narrowed neck segment of the handle, and each having an enlarged opening communicating with the slot for receiving the handle and for retaining the weight members to the handle when the weight members are offset from the narrowed neck segment of the handle, and a lock nut is engaged with the handle for quickly retaining the weight members to the handle after the weight members have been disengaged from the narrowed neck segment of the handle.

2 Claims, 5 Drawing Sheets

ADJUSTABLE DUMBBELL

BACKGROUND OF THE INVENTION

1. Field of the Invention

The present invention relates to an adjustable dumbbell, and more particularly to an adjustable dumbbell including an improved structure for allowing the weight members to be easily and adjustably attached to or disengaged from the weight carrier or handle and for allowing the adjustable dumbbell to be easily operated by the users.

2. Description of the Prior Art

Typical dumbbells comprise a handle to be grasped or held by the user, and a number of weight plates to be attached onto the ends of the handle for weight lifting or exercising purposes, or for exercising or training the upper muscle groups or the lower muscle groups of the user.

For example, U.S. Pat. No. 5,839,997 to Roth et al. discloses a typical adjustable dumbbell comprising a series of plates in stacked relationship, a handle having a shaft passing through the weight plates, and a sleeve and a plate engaged onto the shaft and the weight plates for selectively or adjustably attaching the weight plates to the shaft.

However, the sleeve and the plate may not be easily or quickly assembled onto the shaft and into the weight plates such that the typical adjustable dumbbell may not be easily or quickly assembled or manufactured.

U.S. Pat. No. 5,879,274 to Mattox discloses another typical adjustable dumbbell comprising a series of weighted plates to be attached onto the ends of the handle, and a number of receptacles and spring-biased shafts are required to be attached onto the ends of the handle for mounting or securing the weighted plates on the ends of the handle.

However, the receptacles and the spring-biased shafts may not be easily or quickly assembled onto the handle such that the typical adjustable dumbbell may not be easily or quickly assembled or manufactured.

U.S. Pat. No. 6,656,093 to Chen discloses a further typical dumbbell comprising a handle which can be grasped or held by the user, a number of weight plates to be attached onto the ends of the handle for exercising or training the arms or the feet of the user, and a latch attached onto the end of the handle and/or the weighted plates for selectively or adjustably mounting or securing the weighted plates on the ends of the handle.

However, the latch may not be easily or quickly assembled onto the handle or the weighted plates such that the typical adjustable dumbbell may not be easily or quickly assembled or manufactured.

U.S. Pat. No. 6,719,674 to Krull, and U.S. Pat. No. 6,733,424 to Krull disclose the further typical adjustable dumbbells each comprising a series of weighted plates to be attached onto the ends of the handle, and a number of weight selectors or selector rods should be attached onto the ends of the handle and/or the weighted plates for selectively or adjustably mounting or securing the weighted plates on the ends of the handle.

However, the weight selectors or selector rods may not be easily or quickly assembled onto the handle or the weighted plates such that the typical adjustable dumbbell may not be easily or quickly assembled or manufactured.

U.S. Pat. No. 7,137,931 to Liu, U.S. Pat. No. 7,172,536 to Liu, and U.S. Pat. No. 7,223,214 to Chen disclose the other typical adjustable dumbbells each comprising a series of weighted plates to be attached onto the ends of the handle, and a number of latching members or a complicated latch device should be attached onto the ends of the handle and/or the weighted plates for selectively or adjustably mounting or securing the weighted plates on the ends of the handle.

However, the latching members or the complicated latch device may not be easily or quickly assembled onto the handle or the weighted plates such that the typical adjustable dumbbell may not be easily or quickly assembled or manufactured.

The present invention has arisen to mitigate and/or obviate the afore-described disadvantages of the conventional adjustable dumbbells.

SUMMARY OF THE INVENTION

The primary objective of the present invention is to provide an adjustable dumbbell including an improved structure for allowing the weight members to be easily and adjustably attached to or disengaged from the weight carrier or handle and for allowing the adjustable dumbbell to be easily operated by the users.

In accordance with one aspect of the invention, there is provided an adjustable dumbbell comprising a handle including a first end portion, and including a second end portion, and including an outer thread formed on each of the first and the second end portions of the handle, and including a narrowed neck segment formed in each of the first and the second end portions of the handle, a base plate provided on each of the first and the second end portions of the handle and including an outer diameter greater than that of the handle, at least two weight members each including a slot formed therein and having a width no less than the narrowed neck segment of the handle for receiving the narrowed neck segment of the handle, and for allowing the weight members to be attached to and disengaged from either of the first and the second end portions of the handle, the weight members each including an enlarged opening formed therein and communicating with the slot of the weight members, and the enlarged opening including an inner diameter greater than the width of the slots of the weight members and no less than the outer diameter of the handle for receiving the handle, and for allowing the weight members to be retained to the handle and for preventing the weight members from being disengaged from the handle when the weight members are offset from the narrowed neck segment of the handle, and a lock nut including an inner thread for engaging with the outer thread of the handle and for engaging with the weight members after the weight members have been engaged onto the handle and after the weight members have been disengaged from the narrowed neck segment of the handle, in order to retain and secure the weight members to the handle.

The handle includes at least one notch formed in either of the first and the second end portions of the handle for forming the narrowed neck segment in either of the first and the second end portions of the handle.

The weight members each include an open end communicating with the slots of the weight members for guiding the narrowed neck segment of the handle into the slots of the weight members.

The handle includes a casing secured to each of the base plates. The handle includes a hand grip provided on a central portion of the handle for being grasped or held by the users and for carrying or lifting or moving the handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
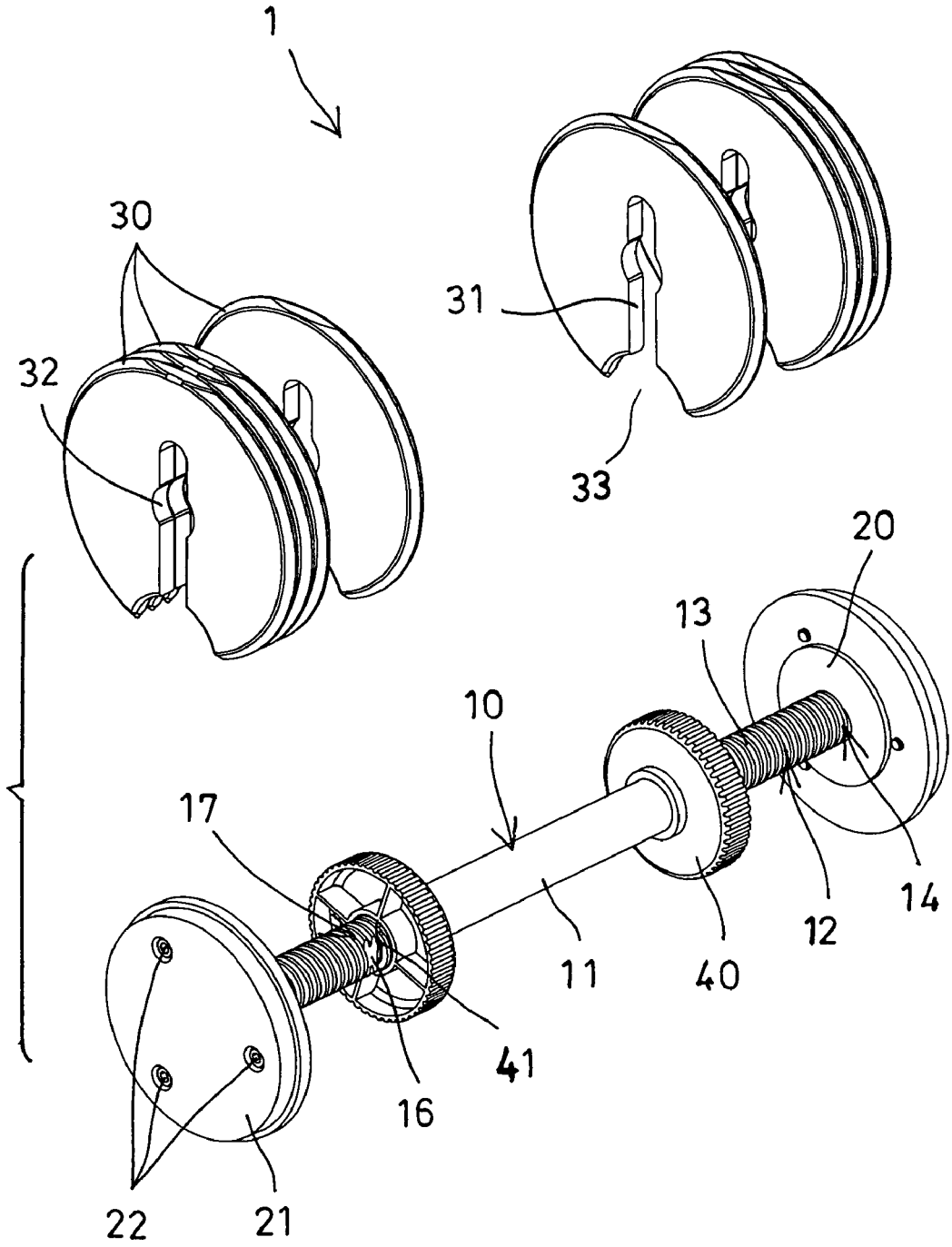
FIG. 1 is a partial exploded view of an adjustable dumbbell in accordance with the present invention.
Figure 2:
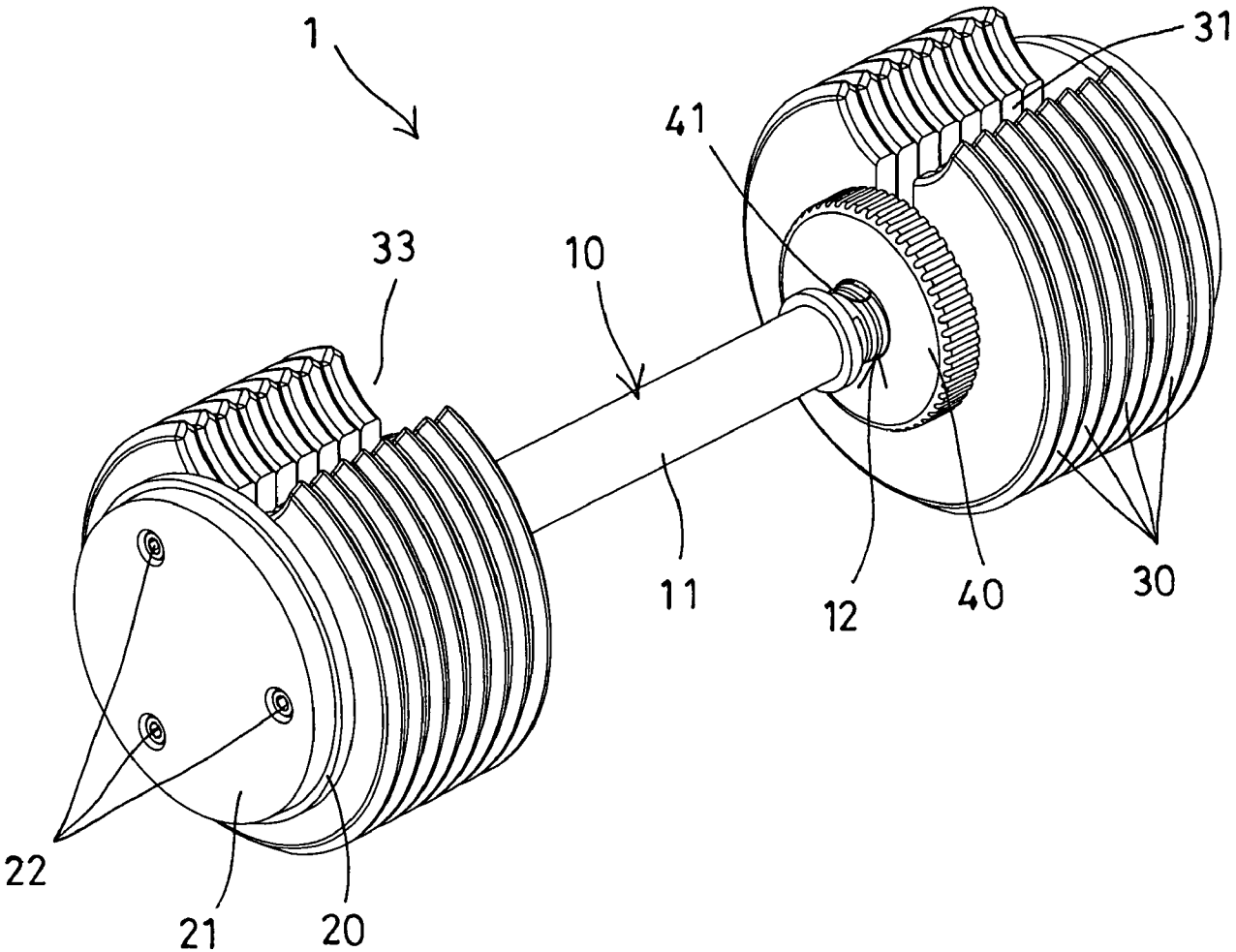
FIG. 2 is a perspective view of the adjustable dumbbell.

Referring to the drawings, and initially to FIGS. 1-4, an adjustable dumbbell 1 in accordance with the present invention comprises a longitudinal shaft or handle 10 including a hand grip 11 formed or provided on the center portion thereof for being grasped or held by the users and for carrying or lifting or moving the handle 10 and for allowing the adjustable dumbbell 1 to be easily operated by the users, and including two end members or end portions 12 each having an outer thread 13 formed or provided on the outer peripheral portion of the end portions 12 of the handle 10. A carrier or base plate 20 is attached or secured to each of the outer portions or outer end portions 14 of the handle 10 with one or more latches or fasteners 15 (FIG. 4), in which the base plate 20 includes an outer diameter greater than that of the handle 10.

A pad or cushion or casing 21 is attached or secured to the outer portion of each of the base plates 20 with one or more latches or fasteners 22. The handle 10 includes one or more (such as two) cut-off portions or notches 16 oppositely formed in each of the end portions 12 of the handle 10 for forming a narrowed neck segment 17 in the end portion 12 of the handle 10 (FIGS. 1, 4), in which a portion of the narrowed neck segment 17 of the handle 10 includes an outer diameter smaller than that of the handle 10.

Figure 3:
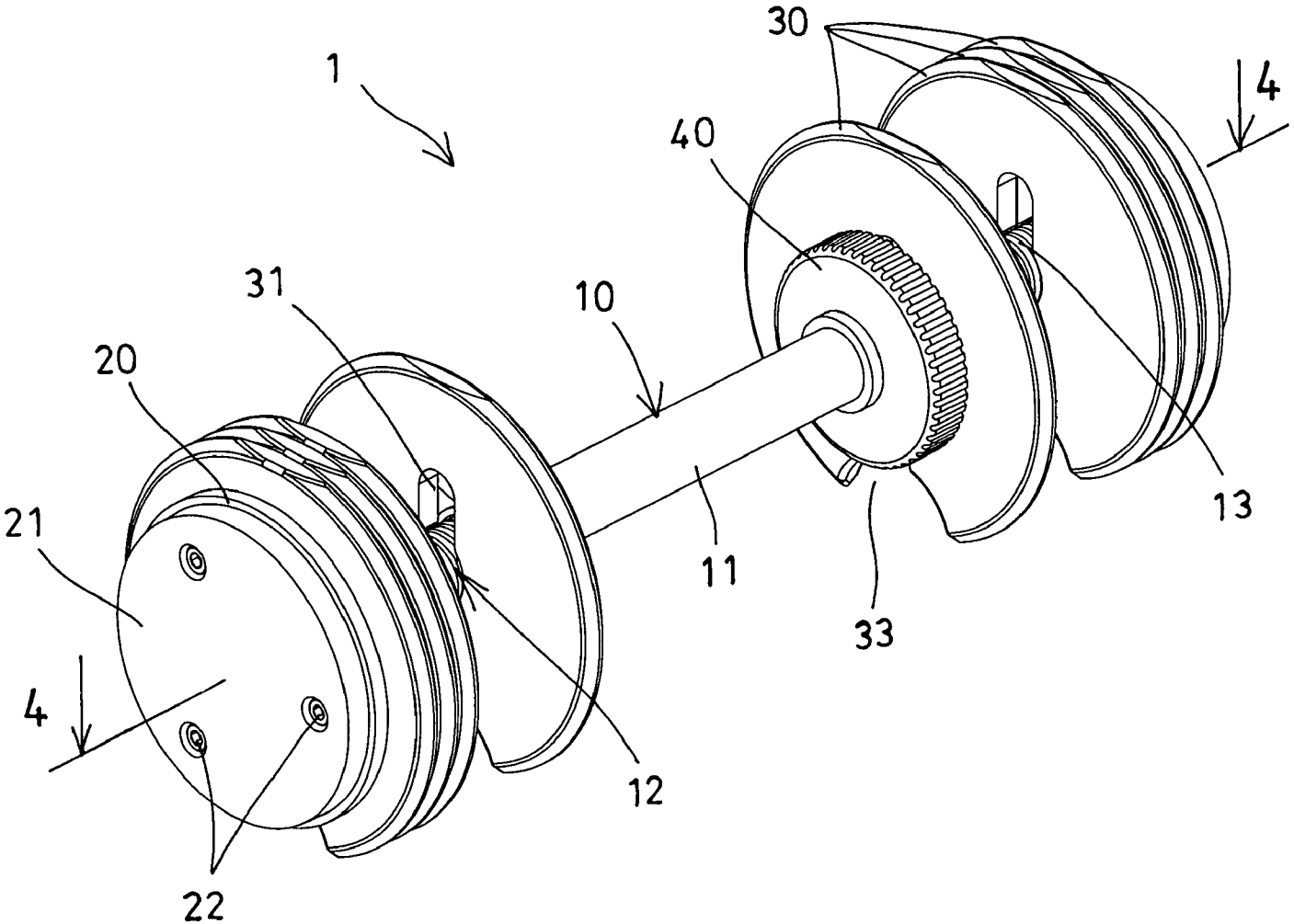
FIG. 3 is another perspective view illustrating the operation of the adjustable dumbbell.
Figure 4:
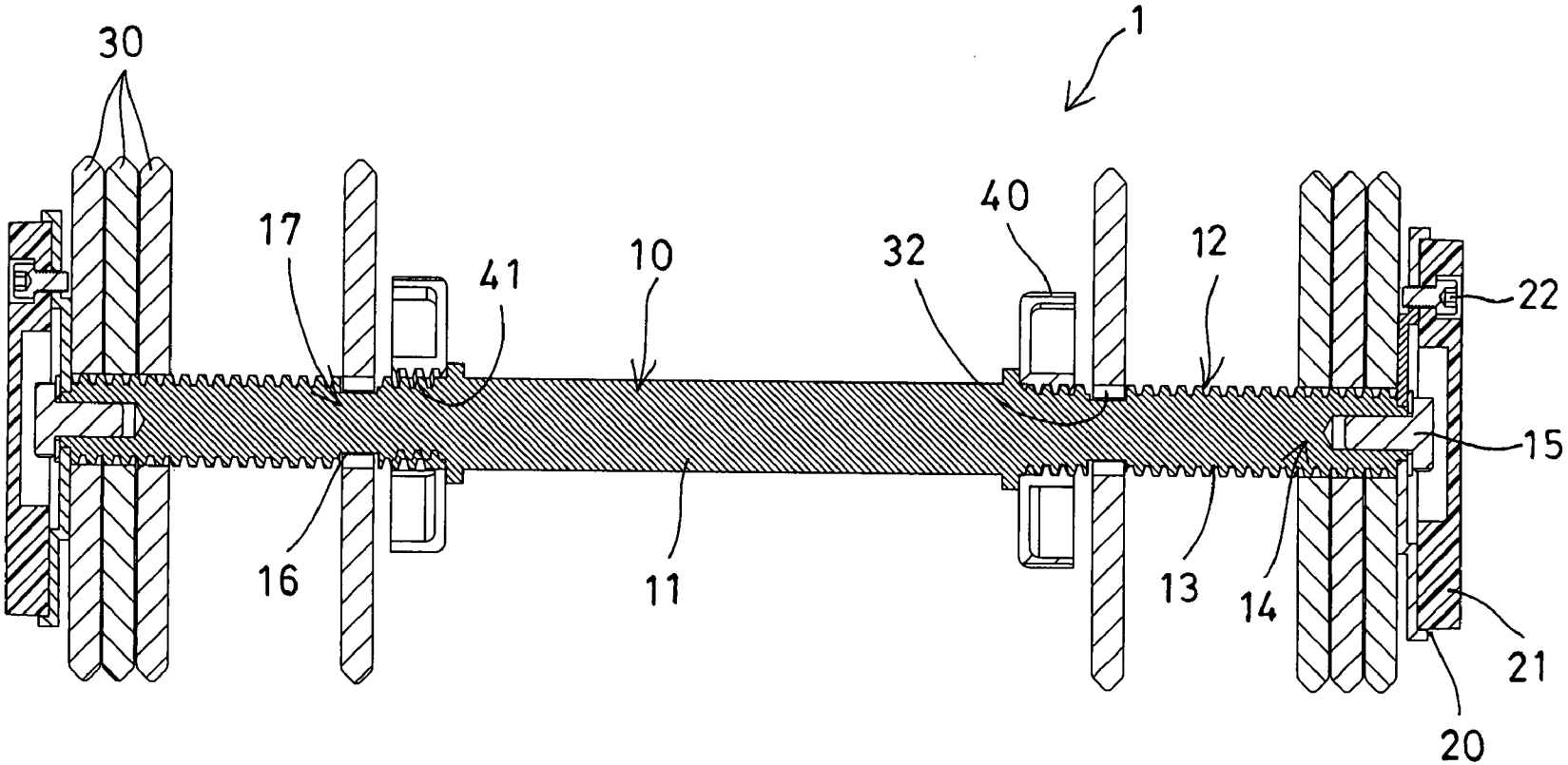
FIG. 4 is a cross sectional view of the adjustable dumbbell taken along lines 4-4 of FIG. 3.

A number of weight plates or weight members 30 each include a substantially U-shaped structure having a slot 31 formed therein for receiving the narrowed neck segment 17 of the central handle 10, and for allowing the weight members 30 to be easily and quickly attached to or disengaged from the central handle 10 without disengaging or disassembling the base plate 20 from the handle 10, in which the slots 31 of the weight members 30 include a width equals to or slightly greater than or no less than the narrowed portion the narrowed neck segment 17 of the handle 10, but smaller than the outer diameter of the other portion of the handle 10, for allowing only the narrowed portion the narrowed neck segment 17 of the handle 10 to be engaged into the slots 3'1 of the weight members 30 (FIGS. 1, 3-4).

The weight members 30 each further include an enlarged opening 32 formed therein, such as formed in the middle or central portion thereof and communicating with the slot 31 of the weight member 30, and having a width or inner diameter greater than the width of the slots 31 of the weight members 30 and equals to or slightly greater than or no less than the outer diameter of the handle 10 for receiving the handle 10, and for allowing the weight members 30 to be stably retained or anchored to the handle 10 and for preventing the weight members 30 from being disengaged from the handle 10 when the weight members 30 are offset from the narrowed neck segment 17 of the handle 10.

It is preferable that the weight members 30 each include a wide open end 33 formed at one end of the slot 31 of the weight member 30 or communicating with the slot 31 of the weight member 30 for allowing the narrowed neck segment 17 of the handle 10 to be guided to easily and quickly engage into the slots 31 of the weight members 30. A fastener or lock nut 40 includes a screw hole or an inner thread 41 for threading or engaging with the outer thread 11 of the handle 10 and for engaging with the weight members 30 after the weight members 30 have been engaged onto the handle 10 and after the weight members 30 have been disengaged or offset from the narrowed neck segment 17 of the handle 10 (FIG. 2), in order to stably anchor or position or retain or secure the weight members 30 to the handle 10.

In operation, as shown in FIGS. 1 and 3-4, the selected or the required number of the weight members 30 may be easily and quickly engaged onto the handle 10 by engaging the narrowed neck segment 17 of the handle 10 into the slots 31 of the weight members 30, and the weight members 30 may then be disengaged or offset from the narrowed neck segment 17 of the handle 10 and may have the handle 10 stably anchored or positioned or retained or secured in the enlarged openings 32 of the weight members 30 relatively when the weight members 30 are disengaged or offset from the narrowed neck segment 17 of the handle 10. The lock nut 40 may then be threaded or rotated relative to the handle 10 and may be engaged with the weight members 30 for stably locking or securing the weight members 30 to the handle 10.

Figure 5:
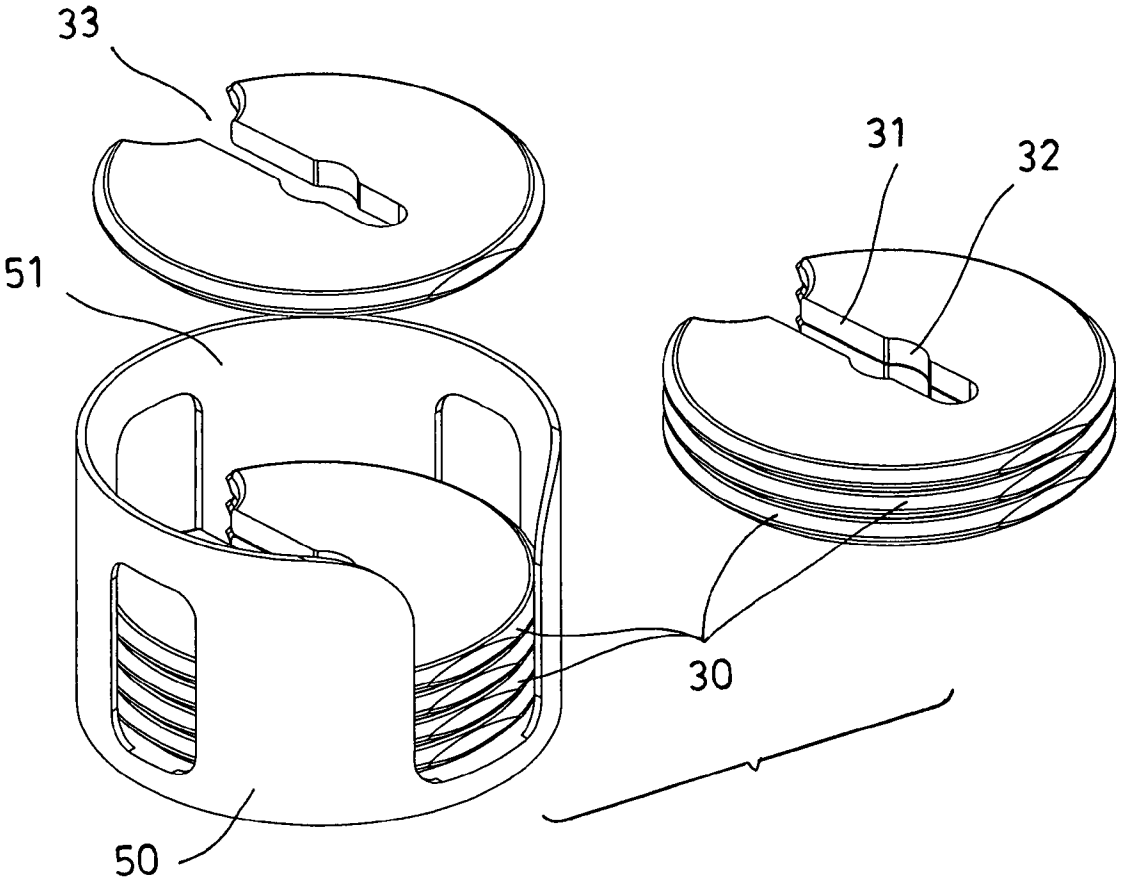
FIG. 5 is another partial exploded view illustrating the storage housing for the adjustable dumbbell.

It is to be noted that the selected or the required number of the weight members 30 may be easily and quickly engaged onto the handle 10 without disengaging or disassembling the base plate 20 from the handle 10, and may be easily and quickly locked or secured to the handle 10 with the lock nut 40, such that the weight members 30 may be changeably and easily and quickly mounted or attached to the handle 10. Accordingly, when the lock nut 40 is disengaged or offset from the narrowed neck segment 17 of the handle 10, the weight members 30 may be easily and quickly engaged onto or disengaged from the handle 10. As shown in FIG. 5, one or more storage housings or receptacles 50 may further be provided and include a chamber 51 formed therein for receiving or storing the weight members 30.

Accordingly, the adjustable dumbbell in accordance with the present invention includes an improved structure for allowing the weight members to be easily and adjustably attached to or disengaged from the weight carrier or handle and for allowing the adjustable dumbbell to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell comprising:

a handle including a first end portion, and including a second end portion, and including an outer thread formed on each of said first and said second end portions of said handle, and including at least one notch formed in either of said first or said second end portion of said handle for forming a narrowed neck segment in either of said first or said second end portion of said handle, and including a hand grip provided on a central portion of said handle, a base plate provided on each of said first and said second end portions of said handle and including an outer diameter greater than that of said handle, at least two weight members each including a slot formed therein and having a width no less than said narrowed neck segment of said handle for receiving said narrowed neck segment of said handle, and for allowing said at least two weight members to be attached to and disengaged from either of said first and said second end portions of said handle, said at least two weight members each including an enlarged opening formed therein and communicating with said slot of said at least two weight members, and said enlarged opening including an inner diameter greater than the width of said slots of said at least two weight members and no less than the outer diameter of said handle for receiving said handle, and for allowing said at least two weight members to be retained to said handle and for preventing said at least two weight members from being disengaged from said handle when said at least two weight members are offset from said narrowed neck segment of said handle, and said at least two weight members each including an open end communicating with said slots of said at least two weight members and extending to and including an entire radius of said at least two weight members for guiding said narrowed neck segment of said handle into said slots of said at least two weight members, and a lock nut including an inner thread for engaging with said outer thread of said handle and for engaging with said at least two weight members after said at least two weight members have been engaged onto said handle and after said at least two weight members have been disengaged from said narrowed neck segment of said handle, in order to retain and secure said at least two weight members to said handle.

2. The adjustable dumbbell as claimed in claim 1, wherein said handle includes a casing secured to each of said base plates.

* * * * *